US010369610B2

(12) United States Patent
Hidaka et al.

(10) Patent No.: US 10,369,610 B2
(45) Date of Patent: Aug. 6, 2019

(54) PRESS DEVICE, MANUFACTURING LINE, AND MANUFACTURING METHOD OF PRESS DEVICE

(71) Applicant: TOYOTA JIDOSHA KABUSHIKI KAISHA, Toyota-shi, Aichi-ken (JP)

(72) Inventors: Koichi Hidaka, Miyoshi (JP); Hideki Asadachi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 545 days.

(21) Appl. No.: 14/916,711

(22) PCT Filed: Sep. 10, 2014

(86) PCT No.: PCT/JP2014/004652

§ 371 (c)(1),
(2) Date: Mar. 4, 2016

(87) PCT Pub. No.: WO2015/056398

PCT Pub. Date: Apr. 23, 2015

(65) Prior Publication Data

US 2016/0214160 A1 Jul. 28, 2016

(30) Foreign Application Priority Data

Oct. 16, 2013 (JP) ..... 2013-215540

(51) Int. Cl.

| | |
|---|---|
| ***B21D 22/02*** | (2006.01) |
| ***B30B 1/18*** | (2006.01) |
| ***B30B 15/00*** | (2006.01) |
| ***B21D 37/12*** | (2006.01) |
| ***B30B 15/02*** | (2006.01) |

(52) U.S. Cl.

CPC ..... *B21D 22/02* (2013.01); *B21D 37/12* (2013.01); *B30B 1/18* (2013.01); *B30B 15/007* (2013.01); *B30B 15/028* (2013.01)

(58) Field of Classification Search

CPC ..... B30B 1/18; B30B 15/007; B30B 15/028; B21D 22/02; B21D 37/12; H05K 13/023

See application file for complete search history.

(56) References Cited

U.S. PATENT DOCUMENTS

2013/0276505 A1 10/2013 Kitai

FOREIGN PATENT DOCUMENTS

| | | | |
|---|---|---|---|
| CN | 103328198 | A | 9/2013 |
| JP | H04-253598 | A | 9/1992 |
| JP | H08-174295 | A | 7/1996 |
| JP | 2001-001186 | A | 1/2001 |
| JP | 2001-079735 | A | 3/2001 |
| JP | 2003-126998 | A | 5/2003 |
| JP | 2003-145299 | A | 5/2003 |
| JP | 2012-125810 | A | 7/2012 |
| JP | 2012-125834 | A | 7/2012 |

*Primary Examiner* — Teresa M Ekiert
(74) *Attorney, Agent, or Firm* — Oliff PLC

(57) ABSTRACT

A press device includes a first metal mold, a second metal mold, the first and second metal molds being configured to sandwich a work therebetween and thereby process the work, and a plurality of drives disposed to connect the first metal mold with the second metal mold, the plurality of drives being configured to change a distance between the first and second metal molds, in which each of the first and second metal molds includes a connection part for connecting with the drives, and at least one of the first and second metal molds includes a reinforcement part.

9 Claims, 23 Drawing Sheets

FOUR-AXIS CONFIGURATION

MULTIPLE-AXIS CONFIGURATION

PRESS DEVICE, MANUFACTURING LINE, AND MANUFACTURING METHOD OF PRESS DEVICE

TECHNICAL FIELD

The present invention relates to a press device, a manufacturing line, and a manufacturing method of a press device.

BACKGROUND ART

Various press devices are used for forming metal components. For example, Patent Literature 1 discloses a press device capable of reducing the maximum load exerted on a work when a press forming is performed. In the press device disclosed in Patent Literature 1, a plurality of drive units support an upper mold plate and a lower mold plate. The upper mold of the metal mold is fixed on the bottom side of the upper mold plate and the lower mold of the metal mold is fixed on the top side of the lower mold plate. The plurality of drive units can be independently controlled. Therefore, by lowering the upper mold plate while swinging it, the maximum load in the forming process can be reduced.

CITATION LIST

Patent Literature

Patent literature 1: Japanese Unexamined Patent Application Publication No. 2012-125834

SUMMARY OF INVENTION

Technical Problem

In the press device disclosed in Patent Literature 1, when a plurality of types of works are formed, it is necessary to adjust the size of the plates according to the size of the largest work. Therefore, the flexibility of design is low and the plates are unnecessarily large for the other works. As a result, the overall size of the press device including the plates increases.

The present invention has been made to solve the above-described problem and an object thereof is to provide a press device that is not unnecessarily large for works and hence has high design flexibility, a manufacturing line, and a manufacturing method of such a press device.

Solution to Problem

A press device according to the present invention includes:

a first metal mold;

a second metal mold, the first and second metal molds being configured to sandwich a work therebetween and thereby process the work; and a plurality of drive means disposed to connect the first metal mold with the second metal mold, the plurality of drive means being configured to change a distance between the first and second metal molds, in which each of the first and second metal molds includes a connection part for connecting with the drive means, and at least one of the first and second metal molds includes a reinforcement part.

In the present invention, the first and second metal molds preferably include a plurality of processing parts, to which the work is sent, according to the number of processing steps for the work, and the plurality of processing parts are preferably arranged at unequal pitches in a work sending direction.

In the present invention, the first and second metal molds preferably include a plurality of processing parts, to which the work is sent, according to the number of processing steps for the work, and the plurality of processing parts are preferably arranged in a staggered manner as viewed from a work sandwiching direction.

In the present invention, the first and second metal molds preferably include a plurality of processing parts, to which the work is sent, according to the number of processing steps for the work, and the plurality of processing parts are preferably arranged in a point symmetry as viewed from a work sandwiching direction.

In the present invention, the first and second metal molds preferably include a plurality of sets of processing parts in order to press a plurality of works for which the numbers of processing steps are different from each other.

In the present invention, the press device preferably further includes a third metal mold disposed so that the first metal mold is positioned between the second and third metal molds, when the first metal mold moves to the third metal mold side, the work is preferably processed by sandwiching the work between the third and first metal molds, and when the first metal molds moves to the second metal mold side, the work is preferably processed by sandwiching the work between the second and first metal molds.

In the present invention, the plurality of control means are preferably individually controlled.

A manufacturing line according to the present invention includes:

the above-described press device; and a conveyance robot that conveys the work.

A manufacturing method of a press device according to the present invention is a manufacturing method of a press device, the press device including:

a first metal mold;

a second metal mold, the first and second metal molds being configured to sandwich a work therebetween and thereby process the work; and a plurality of drive means disposed to connect the first metal mold with the second metal mold, the plurality of drive means being configured to change a distance between the first and second metal molds, in which each of the first and second metal molds includes a connection part for connecting with the drive means, and in which the manufacturing method includes:

a step of determining shapes of processing parts of the first and second metal molds in accordance with a shape of a component to be processed;

a step of determining positions of the connection parts in the first and second metal molds;

a step of manufacturing the first and second metal molds; and a step of connecting the first and second metal molds by the plurality of drive means.

Advantageous Effects of Invention

According to the present invention, it is possible to provide a press device that is not unnecessarily large for works and hence has high design flexibility, a manufacturing line, and a manufacturing method of such a press device.

DESCRIPTION OF EMBODIMENTS

Exemplary embodiments according to the present invention are explained hereinafter with reference to the drawings.

First Exemplary Embodiment

Figure 1:
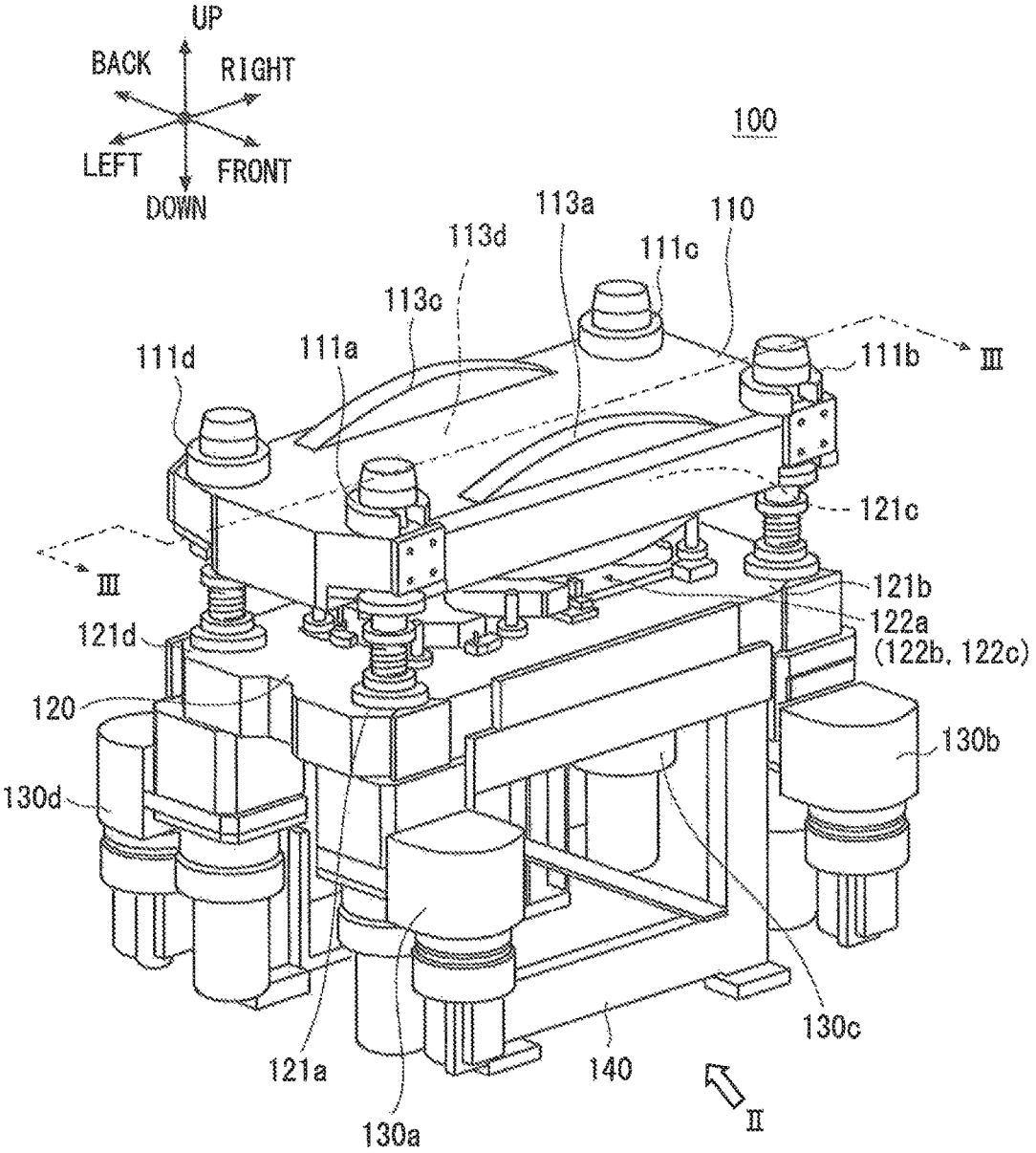
FIG. 1 is a perspective view showing a configuration of a press device according to a first exemplary embodiment.
Figure 2:
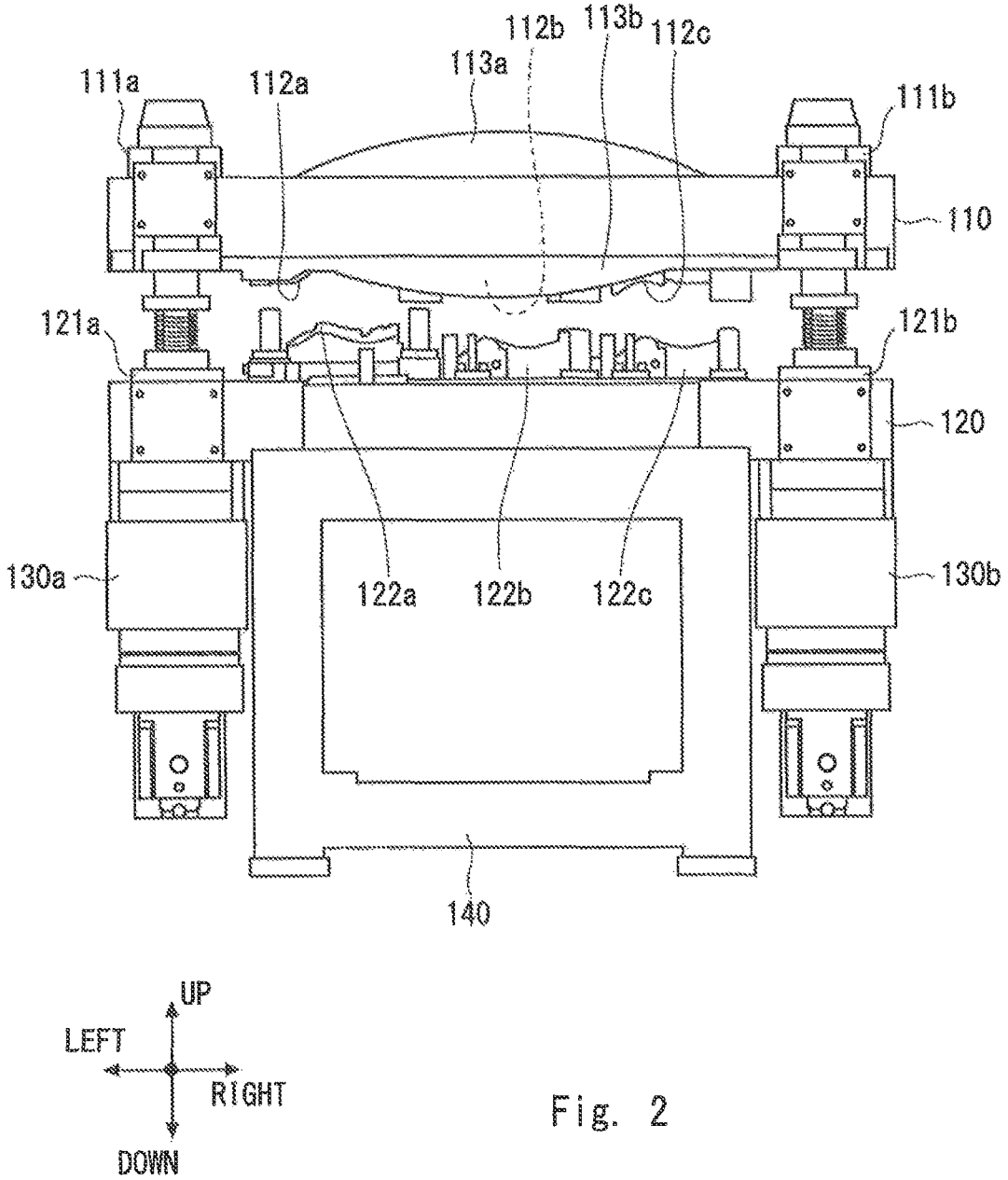
FIG. 2 is a front view showing the configuration of the press device according to the first exemplary embodiment.

A press device 100 according to a first exemplary embodiment of the present invention is explained with reference to FIGS. 1 to 5. FIG. 1 is a perspective view showing a configuration of the press device 100 and FIG. 2 is a front view showing the configuration of the press device 100. The press device 100 includes a first metal mold 110, a second metal mold 120, drive means 130*a* to 130*d*, and a base 140. The press device 100 sandwiches a work between the first and second metal molds 110 and 120, and thereby processes the work.

The base 140 is fixed to the ground and supports the first and second metal molds 110 and 120, and the drive means 130*a* to 130*d*. The second metal mold 120 is fixed on the base 140, which is fixed to the ground.

The first and second metal molds 110 and 120 are metal molds for sandwiching a work therebetween and thereby processing the work. In the press device 100, the first metal mold 110 functions as an upper mold and the second metal mold 120 functions as a lower mold. The first metal mold 110 includes connection parts 111*a* to 111*d* for connecting with the drive means 130*a* to 130*d*. The second metal mold 120 includes connection parts 121*a* to 121*d* for connecting with the drive means 130*a* to 130*d*. One ends of the drive means 130*a* to 130*d* are connected to the connection parts 111*a* to 111*d*, respectively, of the first metal mold 110. The other ends of the drive means 130*a* to 130*d* are connected to the connection parts 121*a* to 121*d*, respectively, of the second metal mold 120. The drive means 130*a* to 130*d* can be easily removed from the connection parts 111*a* to 111*d* and the connection parts 121*a* to 121*d*.

Figure 3:
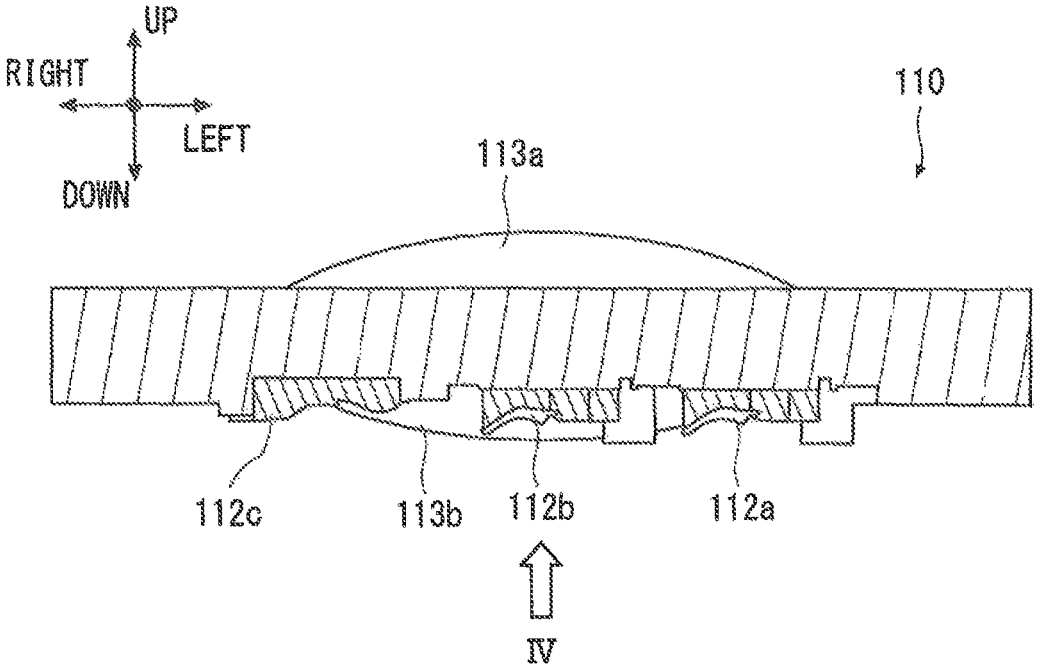
FIG. 3 is a cross section of a first metal mold of the press device according to the first exemplary embodiment.
Figure 4:
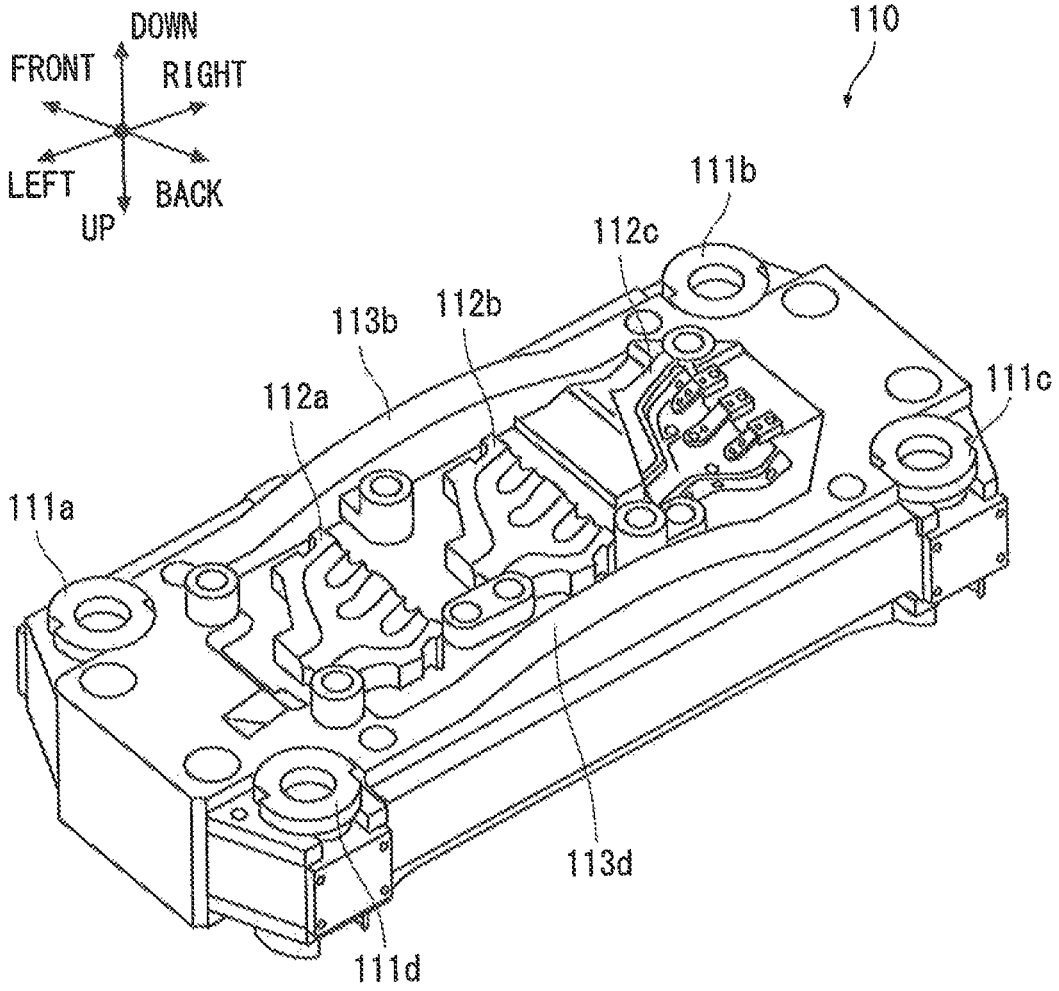
FIG. 4 is a perspective view showing a configuration of the first metal mold removed from the press device according to the first exemplary embodiment.

FIG. 3 is a cross section of the first metal mold 110. FIG. 4 is a rear view of the first metal mold 110 removed from the press device 100. As shown in FIGS. 3 and 4, processing parts 112*a* to 112*c* are provided in the first metal mold 110. Further, processing parts 122*a* to 122*c* are provided in the second metal mold 120. The processing parts 112*a* to 112*c* and the processing parts 122*a* to 122*c* are made of a metal having a strength higher than that of the work. The work can be processed by applying a pressure onto the molds in a state where the work is sandwiched between the processing parts 112*a* to 112*c* of the first metal mold 110 and the processing parts 122*a* to 122*c* of the second metal mold 120.

The first metal mold 110 includes reinforcement parts 113*a* to 113*d*. In the press device 100, since a pressure is applied by connecting the drive means 130*a* to 130*d* at the corners of the first and second metal molds 110 and 120, a large bending stress is exerted on the first and second metal molds 110 and 120. In the forming process, warping occurs in the first and second metal molds 110 and 120 due to this bending stress.

It is conceivable to ensure the rigidity of the first and second metal molds 110 and 120 by increasing the plate thicknesses of the first and second metal molds 110 and 120 in order to reduce the warping of the first and second metal molds 110 and 120. However, if the plate thicknesses are increased, the weight of the metal molds increases, thus requiring large drive means 130*a* to 130*d* capable of producing large forces. As a result, the size and weight of the press device 100 increase. Therefore, it is conceivable to dispose a reinforcement part(s) on the peripheries of the first and second metal molds 110 and 120 in order to increase the strength of the metal molds without increasing their plate thicknesses.

Therefore, at least one of the first and second metal molds 110 and 120 preferably includes a reinforcement part. Needless to say, both of the first and second metal molds 110 and 120 may have reinforcement parts. In each of the first and second metal molds 110 and 120, the reinforcement part(s) may be provided on both of the front and rear surfaces or may be provided on only one of the front and rear surfaces. The reinforcement part is preferably disposed between neighboring connection parts. For example, as shown as a reinforcement part 113*a* in FIG. 1, a hogback-shaped (or arc-shaped) rib having such a shape that an area near the connection part 111*a* is connected with an area near the connection part 111*b* by both ends of the arc can be used.

Figure 5:
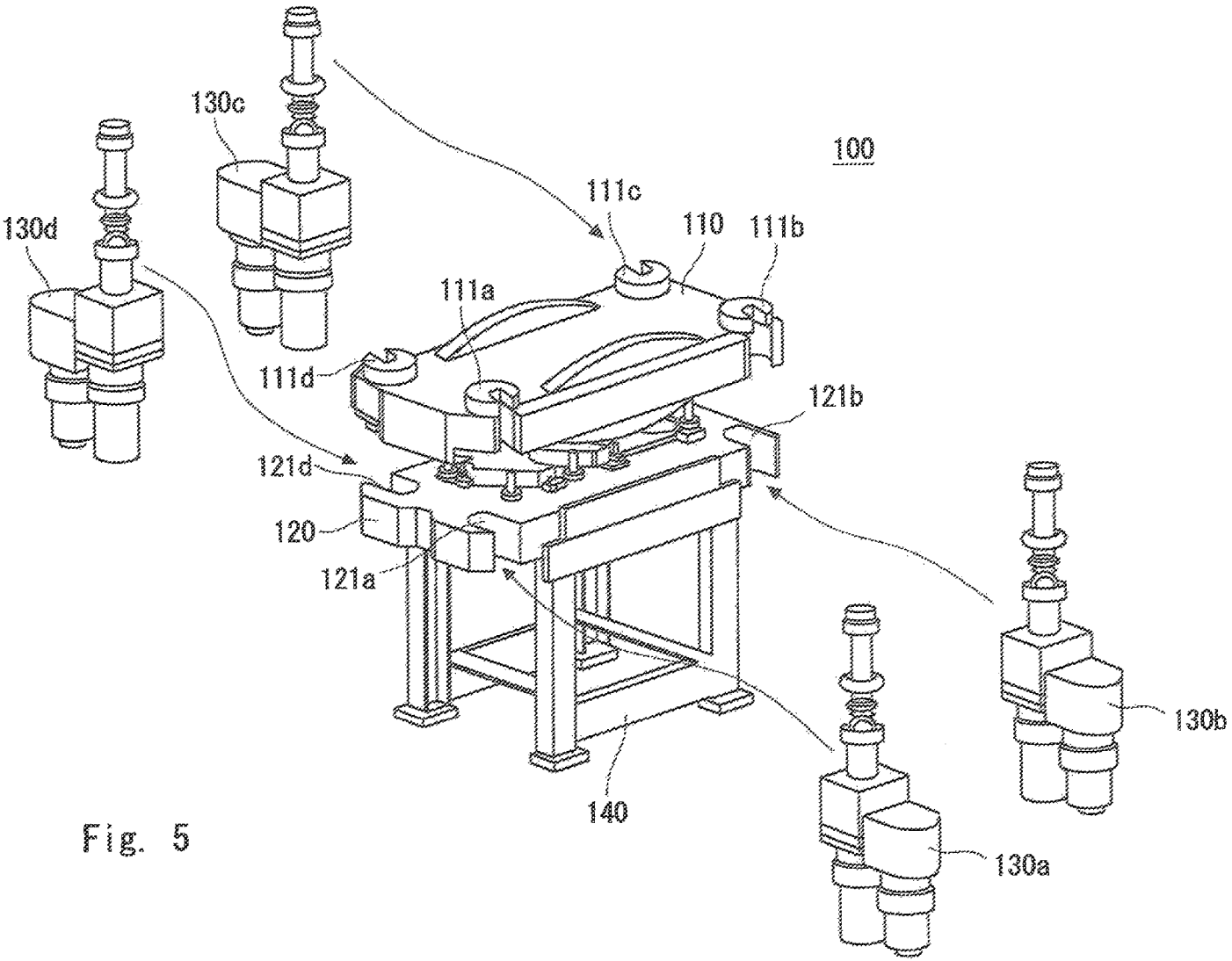
FIG. 5 shows a state where drive means is connected to the press device according to the first exemplary embodiment.

The drive means 130*a* to 130*d* change the distance between the first and second metal molds 110 and 120. As shown in FIG. 5, the drive means 130*a* to 130*d* are connected to the connection parts 111*a* to 111*d*, respectively of the first metal mold 110 and the connection parts 121*a* to 121*d*, respectively, of the second metal mold 120. Hydraulic means may be used for the drive means 130*a* to 130*d*. Alternatively, the drive means may be formed by combining servo-motors and ball screws. In the press device 100, the drive means 130*a* to 130*d* are formed by combining servo-motors and ball screws.

By using the plurality of drive means 130*a* to 130*d*, the press device 100 can reduce the necessary maximum pressuring force compared to that in the crank press method. In a press device using the crank press method, rotational energy accumulated in a flywheel is consumed little by little in each process. Therefore, the energy necessary for processing in each process needs to be calculated in a serial manner, thus requiring a large maximum pressuring force as a whole in the press device. In contrast to this, in a press device using a servo press method or a hydraulic press method, the energy necessary for processing can be supplied in a continuous manner. Therefore, the pressuring force does not decrease during the process. Consequently, the energy necessary for each process can be calculated in a parallel manner, thus making it possible to reduce the necessary maximum pressuring force by shifting the processing timing in each process from one process to another process.

The press device 100 does not use the plates, and the first and second metal molds 110 and 120, to which the drive means 130*a* to 130*d* are attached, are not deformed due to the driving forces generated by the drive means 130*a* to 130*d*.

In the press device 100, the plurality of drive means 130*a* to 130*d* can be individually controlled. This feature enables the first metal mold 110 to be moved freely. The pressuring force applied to the first metal mold 110 can be changed on a place-by-place basis by changing the force applied by each of the drive means 130*a* to 130*d*. Further, the angle at which the first metal mold 110 comes into contact with the work can be changed by changing the driving speed of each of the drive means 130*a* to 130*d* so that one end of the first metal mold 110 is swiftly lowered while the other end of the first metal mold 110 is slowly lowered.

Figure 6:
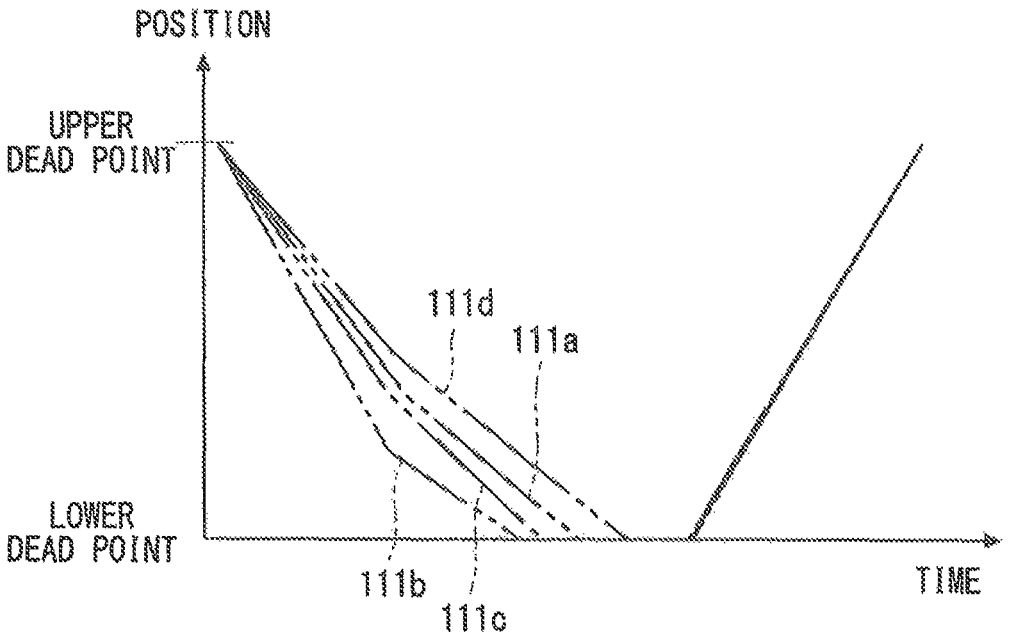
FIG. 6 is a graph showing a movement of the first metal mold in the press device according to the first exemplary embodiment when connection parts of the first metal mold are moved in a disorderly manner.
Figure 7:
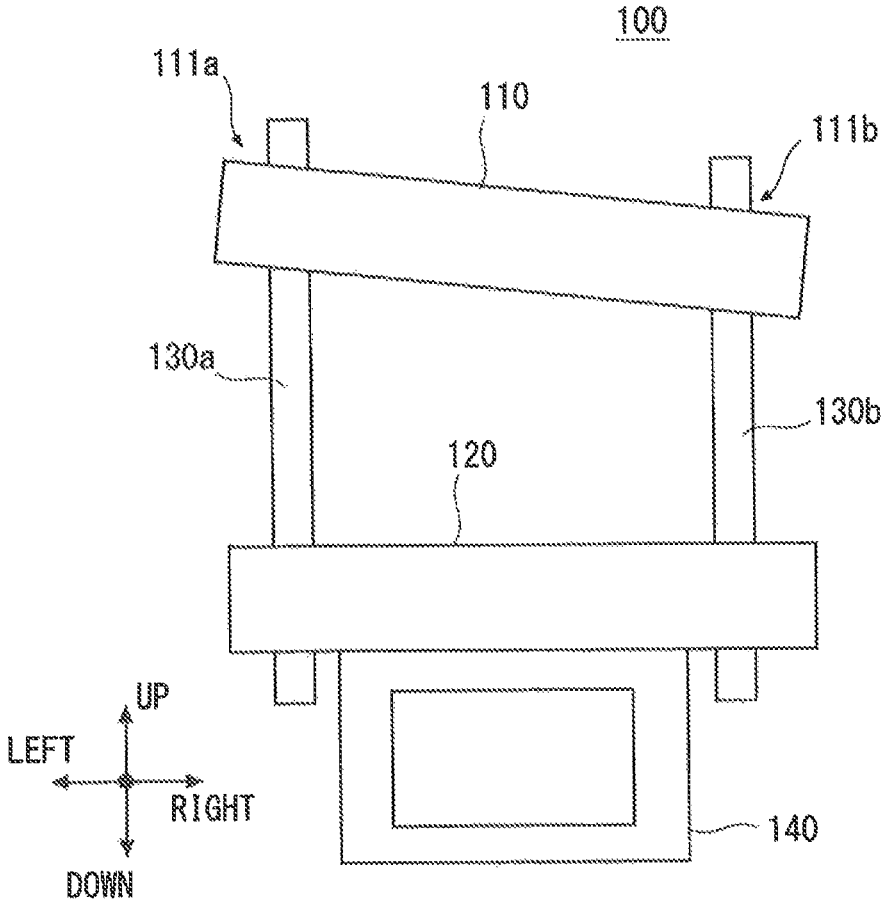
FIG. 7 is a schematic diagram showing a movement of the first metal mold in the press device according to the first exemplary embodiment when the connection parts of the first metal mold are moved in the disorderly manner.

FIG. 6 is a graph showing a movement of the first metal mold 110 when the connection parts 111*a* to 111*d* of the first metal mold 110 are moved in a disorderly manner. The horizontal axis in FIG. 6 indicates the time and the vertical axis indicates where the connection parts 111*a* to 111*d* of the first metal mold 110 are located between the upper dead point and the lower dead point. When the first metal mold 110 is moved as shown in FIG. 6, the first metal mold 110 is inclined so that the connection part 111*b* side is lowered more than the connection part 111*a* is as shown in FIG. 7.

Figure 8:
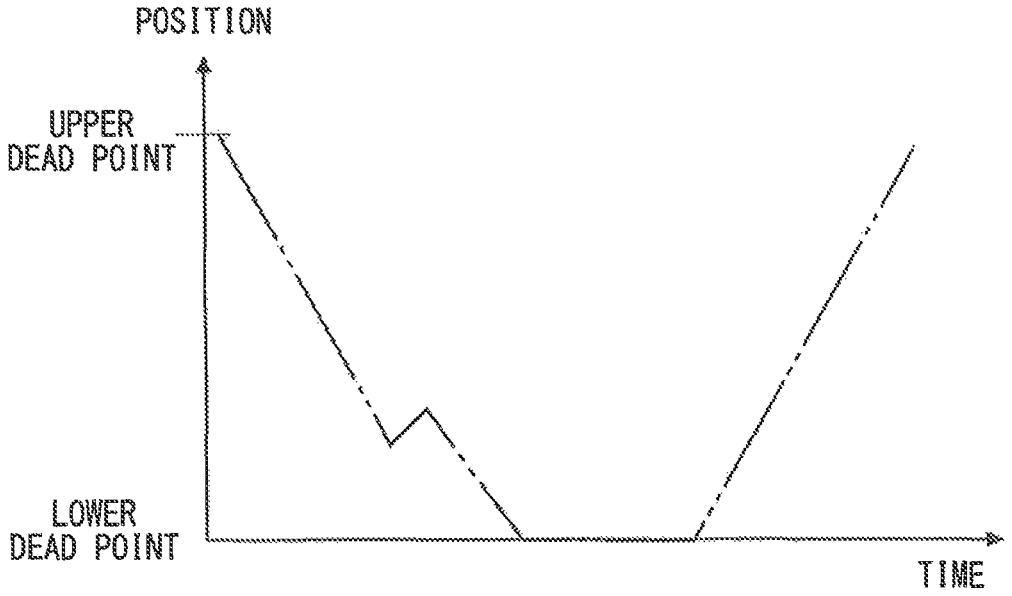
FIG. 8 is a graph showing how to move the first metal mold to prevent cracks in a work in the press device according to the first exemplary embodiment.

Further, as shown in FIG. 8, when the first metal mold 110 is being moved from the upper dead point to the lower dead point, it is possible to temporarily stop the first meat mold 110 halfway between these points and then return the first metal mold 110 toward the upper dead point and then move the first metal mold 110 toward the lower dead point again. In this way, it is possible to reduce the bending stress exerted on the work during the forming process and thereby prevent or suppress cracks in the work. Further, it is possible to improve the accuracy of drawing press forming. Note that the horizontal axis in FIG. 8 indicates the time and the vertical axis indicates where the connection parts 111*a* to 111*d* of the first metal mold 110 are located between the upper dead point and the lower dead point. In FIG. 8, the drive means 130*a* to 130*d* perform the same movements.

Various arrangements of the processing parts 112 and 122 in the first and second metal molds 110 and 120 are explained with reference to FIGS. 9 to 13.

The first and second metal molds 110 and 120 may include a plurality of processing parts 112 and 122, to which a work is sent, according to the number of processing steps for the work. By providing the plurality of processing parts 112 and 122, a forming process including a plurality of steps can be carried out by using a pair of metal molds (the first and second metal molds 110 and 120).

Figure 9:
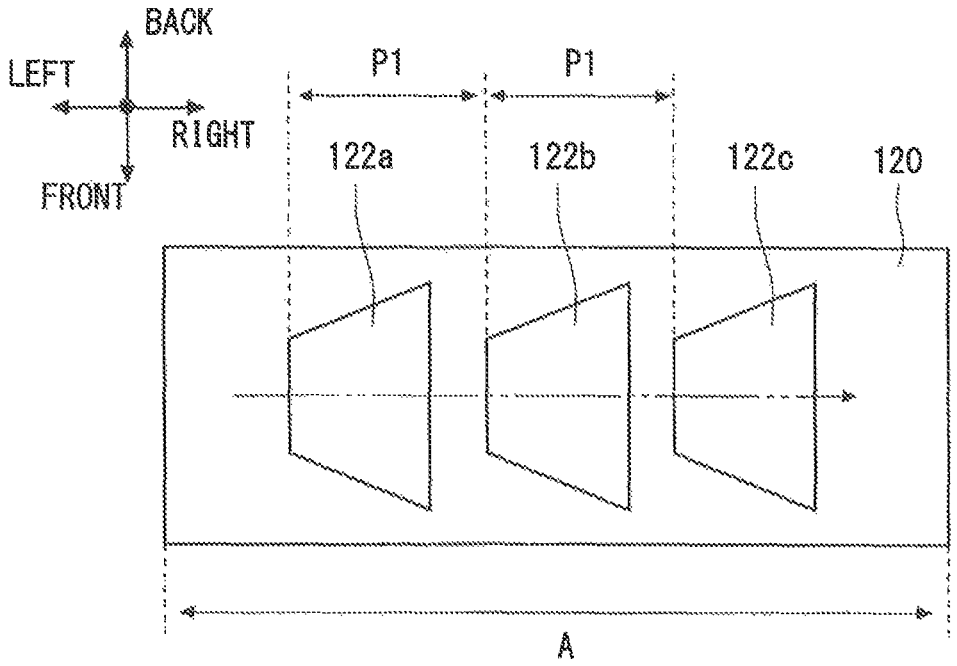
FIG. 9 is a schematic diagram showing a second metal mold in which a plurality of processing parts are arranged at equal pitches in the press device according to the first exemplary embodiment.
Figure 10:
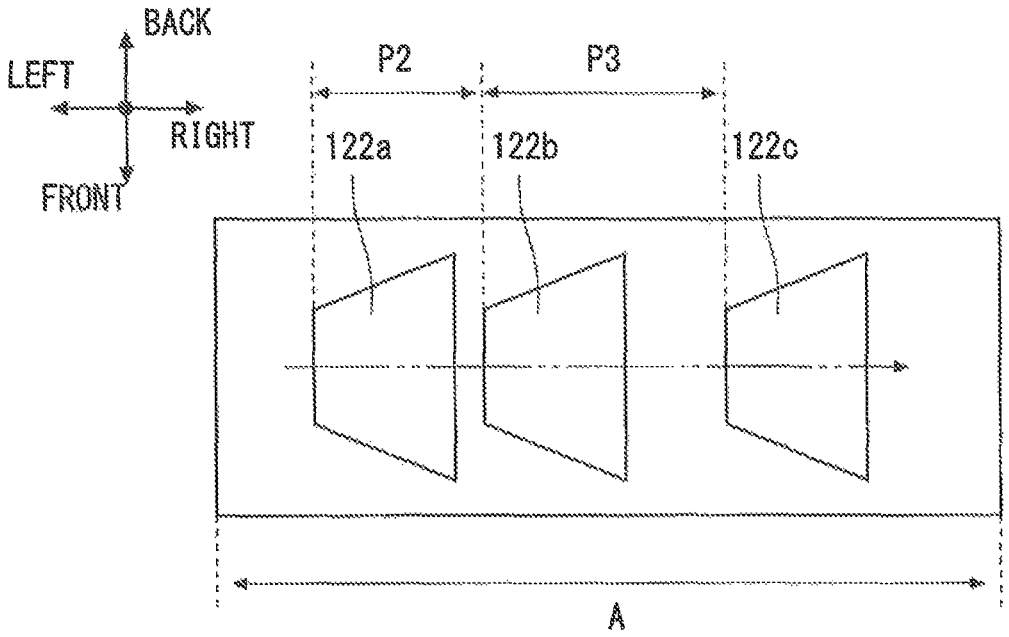
FIG. 10 is a schematic diagram showing a second metal mold in which a plurality of processing parts are arranged at unequal pitches in the press device according to the first exemplary embodiment.

An arrangement of processing parts 122*a* to 122*c* in the rectangular second metal mold 120 having a length A in the work sending direction (left/right direction) is explained with reference to FIGS. 9 and 10. In FIG. 9, a plurality of the processing parts 122*a* to 122*c* are arranged at equal pitches such as intervals P1 in the work sending direction (left/right direction). In contrast to this, in FIG. 10, the distance between the processing parts 122*a* and 122*b* in the work sending direction (left/right direction) is P2 and the distance between the processing parts 122*b* and 122*c* is P3. That is, the plurality of processing parts 122*a* to 122*c* are arranged at unequal pitches.

For the conveyance of a work in a crank-press type press device 100 using progressive metal molds, a conveyance device using a link mechanism is often used. The conveyance device using a link mechanism can convey works only in a straight line and its conveyance pitches are regular intervals. However, by using a revolute robot for conveying a work, it is possible to automatically position the work in the processing parts 122*a* to 122*c* even for a metal mold in which the processing parts 122*a* to 122*c* are arranged at uneven pitches. The arrangement of the plurality of processing parts 122*a* to 122*c* at uneven pitches enables more flexible metal mold designs. Further, since the restriction for even pitches is eliminated, the distances between the processing parts can be reduced.

Figure 11:
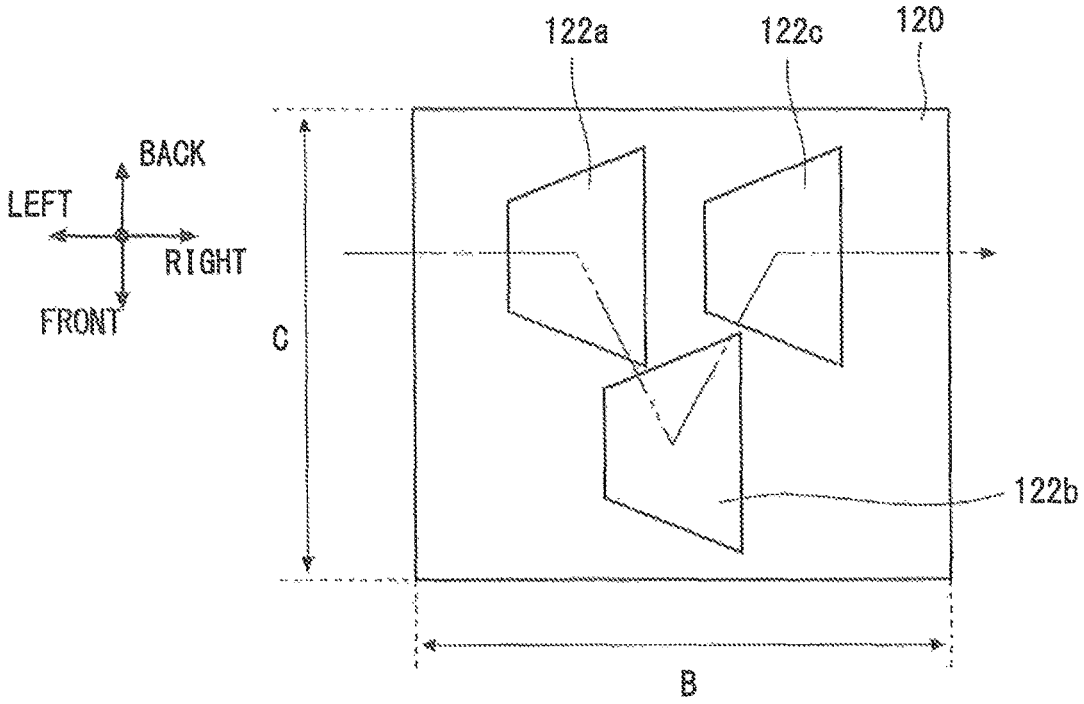
FIG. 11 is a schematic diagram showing a second metal mold in which a plurality of processing parts are arranged in a staggered manner in the press device according to the first exemplary embodiment.

In FIG. 11, a plurality of processing parts 122*a* to 122*c* are arranged in a staggered manner as viewed in the work sandwiching direction (up/down direction). A work is sent to the processing part 122*a*, to the processing part 122*b*, and to the processing part 122*c* in this order. In FIG. 11, the length of the second metal mold 120 in the work sending direction (left/right direction) is B and the length in (the front/back direction) is C, though the sizes of the processing parts 122*a* to 122*c* are the same as those in FIGS. 9 and 10. As a result, the second metal mold 120 is shortened in the left/right direction compared to the case where the processing parts 122*a* to 122*c* are arranged in a row, thus making it possible to reduce the size of the metal mold as a whole. Consequently, it is possible to improve the rigidity of the metal mold against bending.

By using a revolute robot for conveying a work, it is possible to automatically position the work in the processing parts 122*a* to 122*c* even for a metal mold in which the processing parts 122*a* to 122*c* are disposed in a staggered manner. In the case where processing parts are arranged in two rows, there are cases where an operator cannot reach the row on the far side (the processing parts 122*a* and 122*c*) with his/her hand, thus making the conveyance of the work difficult. However, the use of a revolute robot makes it possible to cope with such an arrangement where an operator cannot reach a work with his/her hand.

Figure 12:
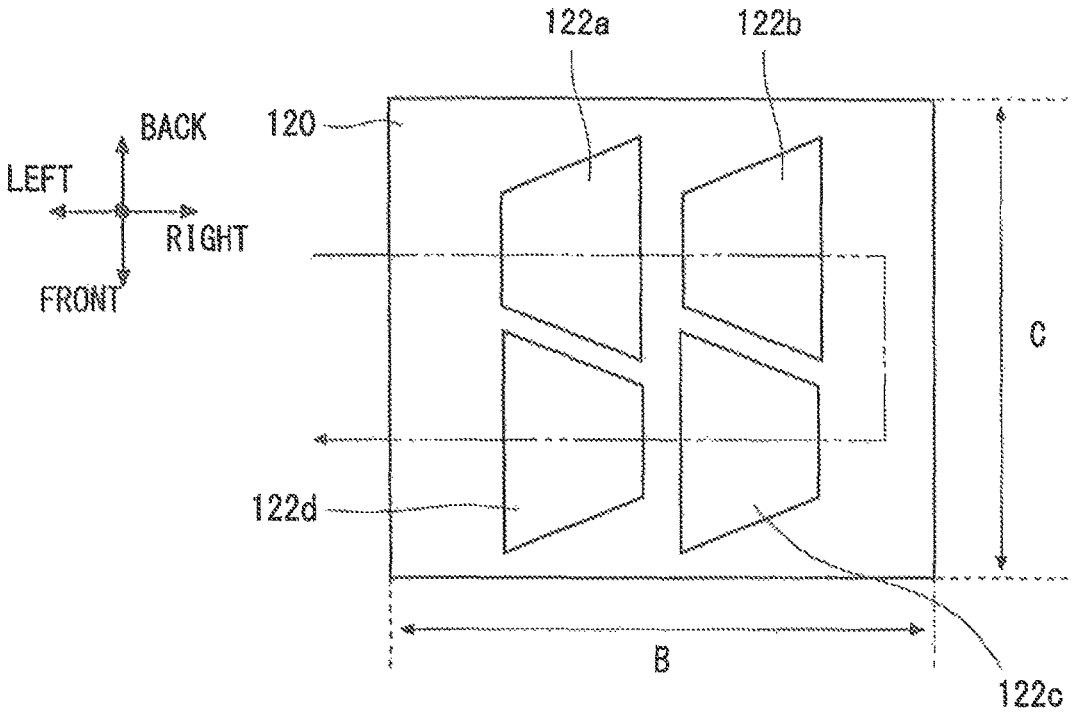
FIG. 12 is a schematic diagram showing a second metal mold in which a plurality of processing parts are arranged in a point symmetry in the press device according to the first exemplary embodiment.

In FIG. 12, a plurality of processing parts 122*a* to 122*d* are arranged in a point symmetry as viewed in the work sandwiching direction (up/down direction). A work is sent to the processing part 122*a*, to the processing part 122*b*, to the processing part 122*c*, and to the processing part 122*d* in this order. The second metal mold 120 is shortened in the left/right direction compared to the case where the processing parts 122*a* to 122*d* are arranged in a row, thus making it possible to reduce the size of the metal mold as a whole. Consequently, it is possible to improve the rigidity of the metal mold against bending. By using a revolute robot for conveying a work, it is possible to automatically position the work in the processing parts 122*a* to 122*d* even for a metal mold in which the processing parts 122*a* to 122*d* are disposed in a point symmetry. Further, although the length of the second metal mold 120 in the work sending direction (left/right direction) is B and the length in (the front/back direction) is C as in the case of FIG. 11, the number of processing parts that can be arranged in the second metal mold 120 is larger than that in the case of FIG. 11 by one.

Figure 13:
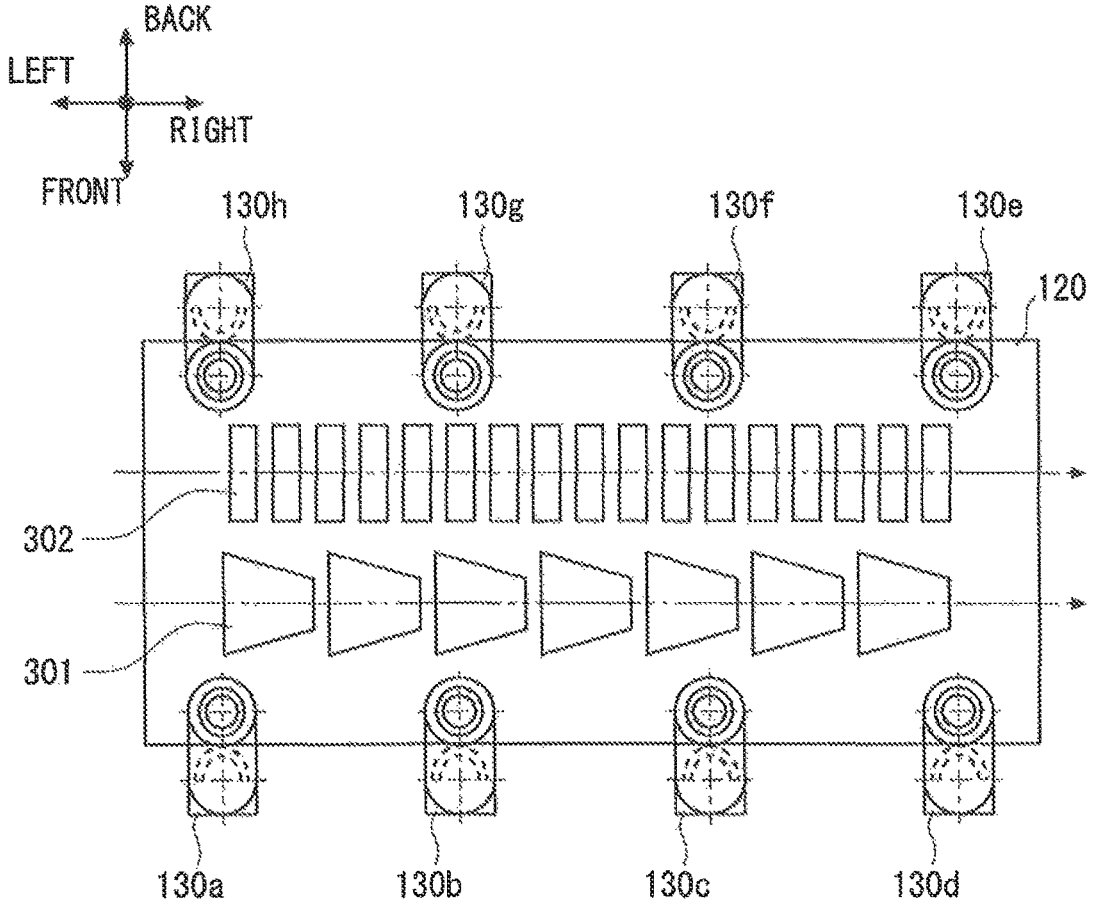
FIG. 13 is a schematic diagram showing a second metal mold including two sets of processing parts in the press device according to the first exemplary embodiment.

In FIG. 13, the first and second metal molds 110 and 120 include two sets of processing parts 301 and 302 in order to press a plurality of works for which the numbers of processing steps are different from each other. The number of sets of processing parts is not limited to two. That is, it may be any number equal to two or greater. For example, the number of sets may be three or greater. By providing a plurality of sets of processing parts, a plurality of components can be processed by using one press device. As a result, the number of press devices in a factory can be reduced and hence the cost can be reduced. Although the pressuring force necessary for the presswork increases as the number of processing parts increases, the necessary pressuring force can be achieved by increasing the number of drive means.

Figure 14:
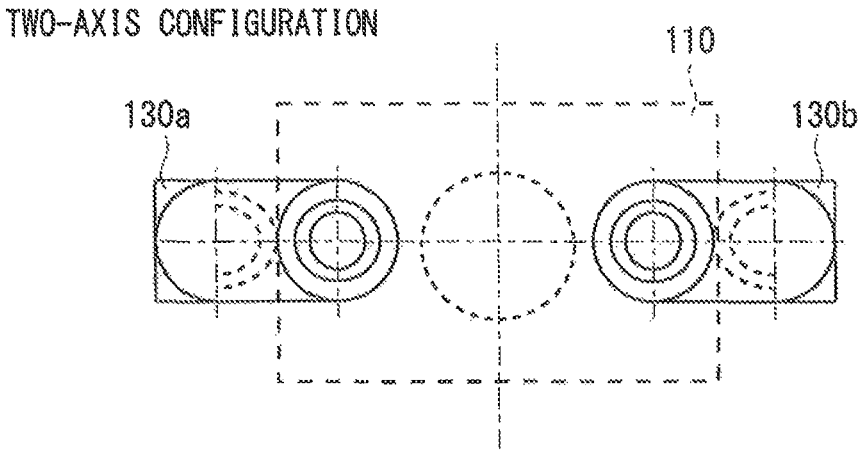
FIG. 14 is a schematic diagram showing an example of an arrangement in the press device according to the first exemplary embodiment in a case where drive means have a two-axis configuration.

An arrangement of drive means is explained with reference to FIGS. 14 to 17. The number and arrangement of the drive means are determined based on the shapes of the first and second metal molds 110 and 120 and the necessary pressuring force. The greater the number of the drive means, the larger the pressuring force the press device 100 can generate. FIG. 14 shows an example of an arrangement in a case where the drive means have a two-axis configuration. The two axes are the minimum necessary number of the driving means in order to perform presswork while changing the pressuring force on the left side of the mold from that on the right side thereof and/or changing the pressing speed on the left side of the mold from that on the right side thereof. The drive means 130*a* and 130*b* are arranged near the centers of the short sides of the first metal mold 110 and are opposed to each other in the left/right direction.

Figure 15:
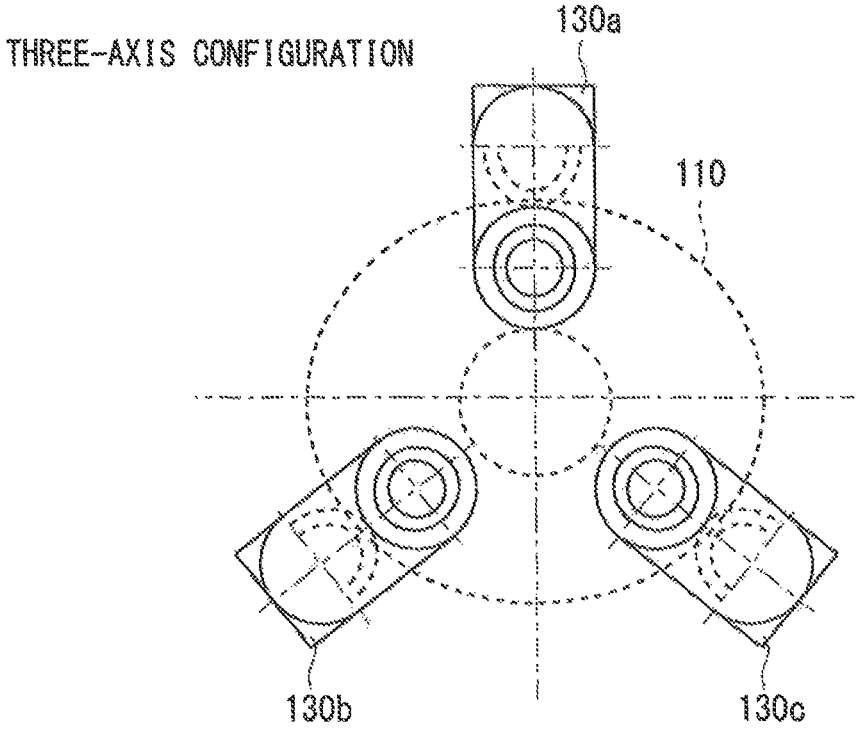
FIG. 15 is a schematic diagram showing an example of an arrangement in the press device according to the first exemplary embodiment in a case where drive means have a three-axis configuration.

FIG. 15 shows an example of an arrangement in a case where the drive means have a three-axis configuration. A uniform pressuring force can be generated by arranging drive means 130*a* to 130*c* at regular intervals of 120 degrees in a peripheral section of the circular first metal mold 110.

Figure 16:
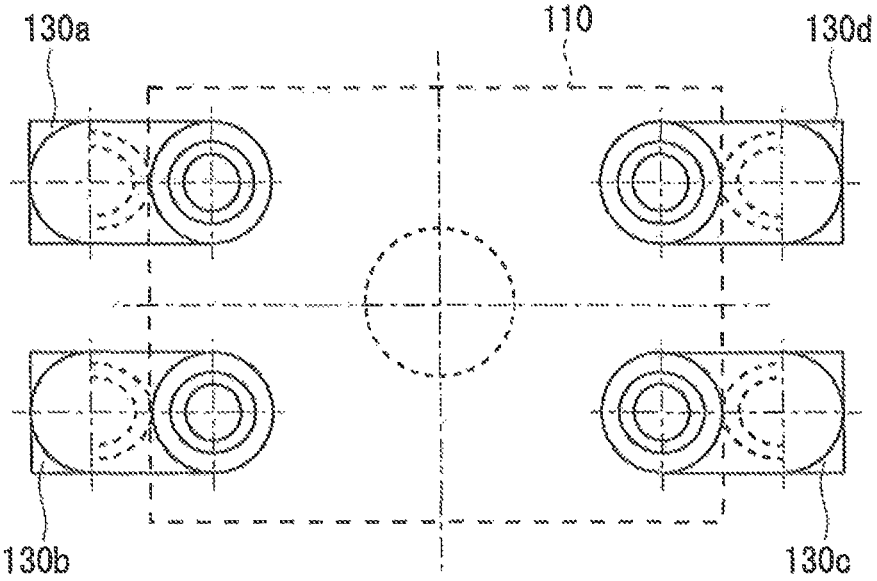
FIG. 16 is a schematic diagram showing an example of an arrangement in the press device according to the first exemplary embodiment in a case where drive means have a four-axis configuration.

FIG. 16 shows an example of an arrangement in a case where the drive means have a four-axis configuration. A uniform pressuring force can be generated by arranging drive means 130*a* to 130*c* at the four corners of the first metal mold 110.

Figure 17:
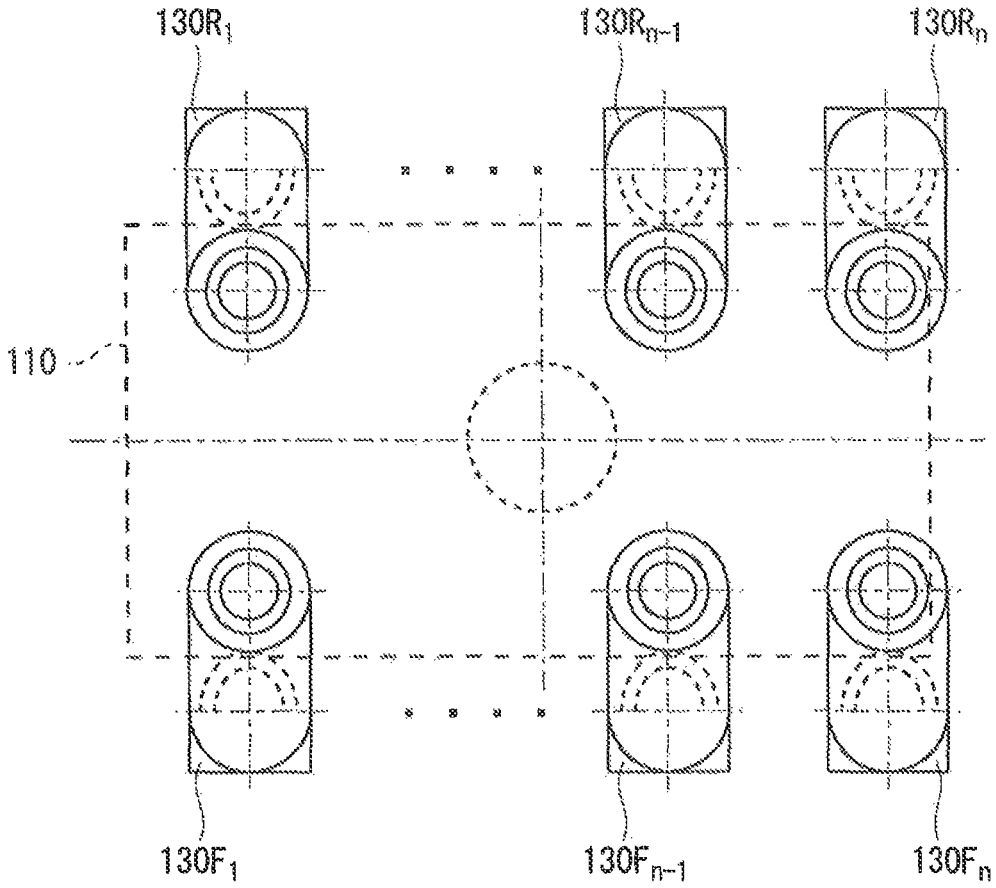
FIG. 17 is a schematic diagram showing an example of an arrangement in the press device according to the first exemplary embodiment in a case where drive means have a six-axis configuration or greater.

FIG. 17 shows an example of an arrangement in a case where the drive means have a six-axis configuration or greater. In total, 2n drive means 130$F_1$-130$F_n$ and 130$R_1$-130$R_n$ are arranged at regular intervals on the long sides of the first metal mold 110. This configuration makes it possible to generate a large pressuring force and generate a uniform pressuring force on the metal mold.

Figure 18:
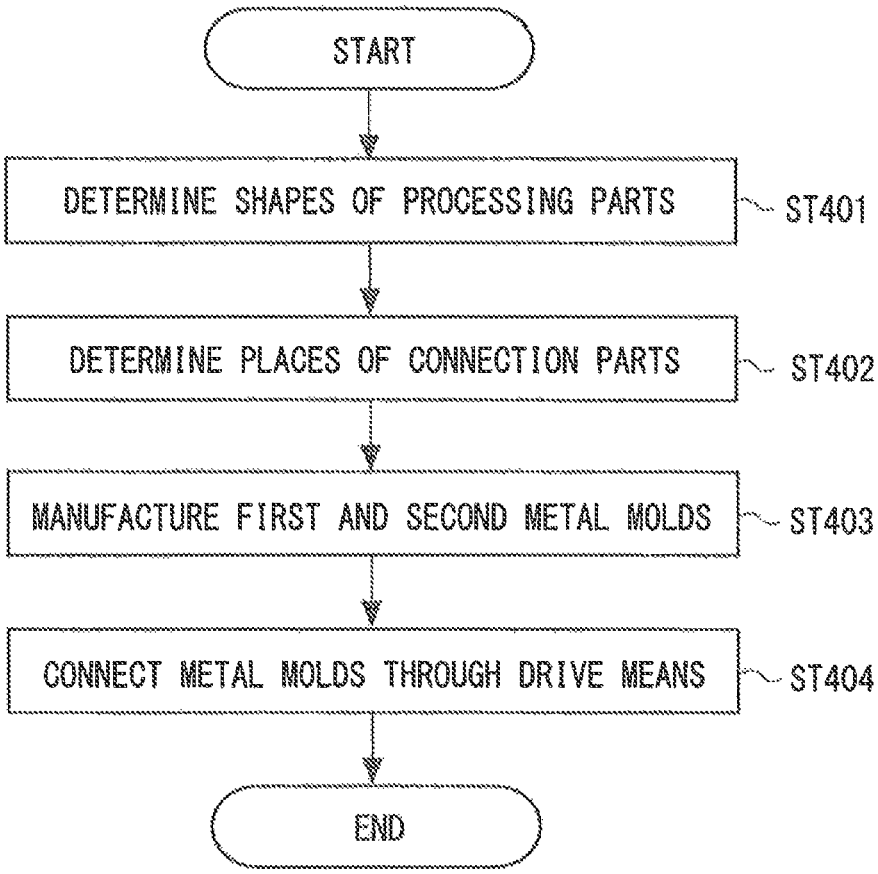
FIG. 18 is a flowchart showing a manufacturing method of a press device according to the first exemplary embodiment.

A method for manufacturing a press device 100 is explained with reference to FIG. 18.

Firstly, the shapes of the processing parts of the first and second metal molds 110 and 120 are determined in accordance with the shape of a component to be processed (ST401). In addition to the shapes of the processing parts, the arrangement of the processing parts in the mold is also determined.

Next, the positions of the connection parts in the first and second metal molds 110 and 120 are determined (ST402). The pressuring force necessary for the presswork can be calculated based on the shapes of the processing parts and the arrangement thereof in the mold. The number and arrangement of the drive means are determined so that the necessary pressuring force is obtained. Further, the positions of the connection parts are determined according to the determined number and arrangement of the drive means. In the press device 100, the number of the drive means is four and four connection parts are arranged in each of the first and second metal molds 110 and 120.

Next, the first and second metal molds 110 and 120 are manufactured (ST403). The first and second metal molds 110 and 120 are manufactured by, for example, machining using a carbide tool.

The first and second metal molds 110 and 120 are connected to each other through the plurality of drive means 130*a* to 130*d* (ST404). The drive means 130*a* to 130*d* are connected to the connection parts 111*a* to 111*d*, respectively, of the first metal mold 110 and the connection parts 121*a* to 121*d*, respectively, of the second metal mold 120. At this time, the second metal mold 120 is fixed on the base 140.

Figure 19:
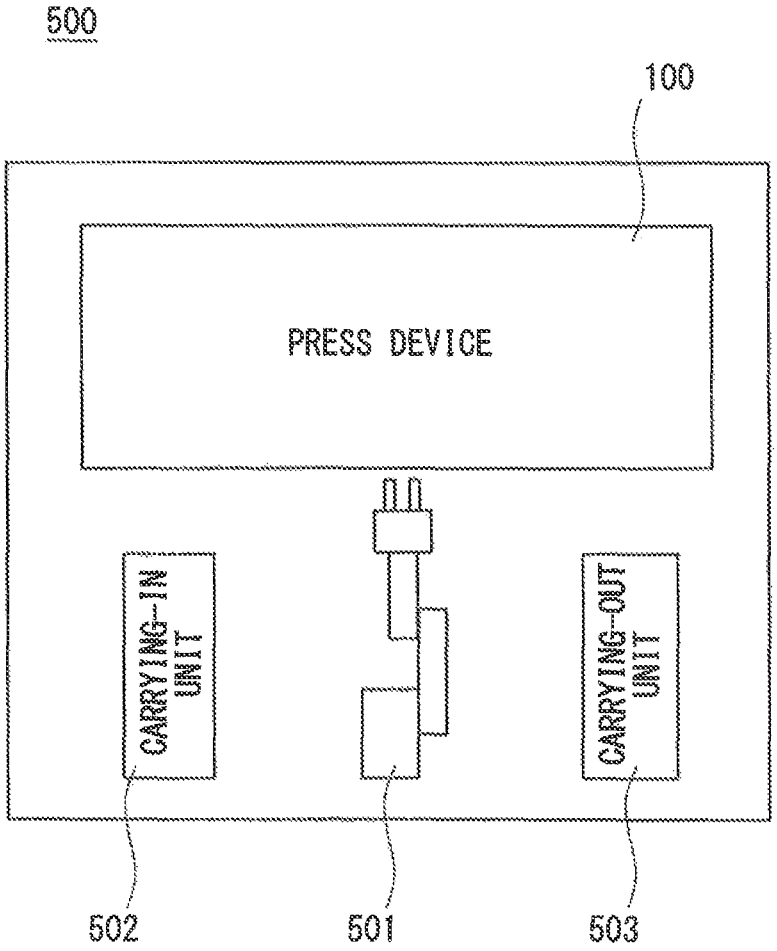
FIG. 19 is a schematic diagram showing a configuration of a manufacturing line using a press device according to the first exemplary embodiment.

A manufacturing line 500 using the press device 100 is explained with reference to FIG. 19. The manufacturing line 500 includes the press device 100, a conveyance robot 501, a carrying-in unit 502, and a carrying-out unit 503.

A work sent from the preceding process is carried into the carrying-in unit 502. The work, which has been processed by the press device 100, is carried out from the carrying-out unit 503 to the subsequent process. The conveyance robot 501 moves the work. That is, the conveyance robot 501 moves the work from the carrying-in unit 502 and positions it in the processing part of the press device 100, moves the work from one process site to another in the press device 100, and moves the work, which has been processed by the press device 100, to the carrying-out unit 503. For example a revolute robot is used as the conveyance robot 501. By combining the press device 100 with the conveyance robot 501, a small and low-cost manufacturing line 500 can be constructed.

Figure 20:
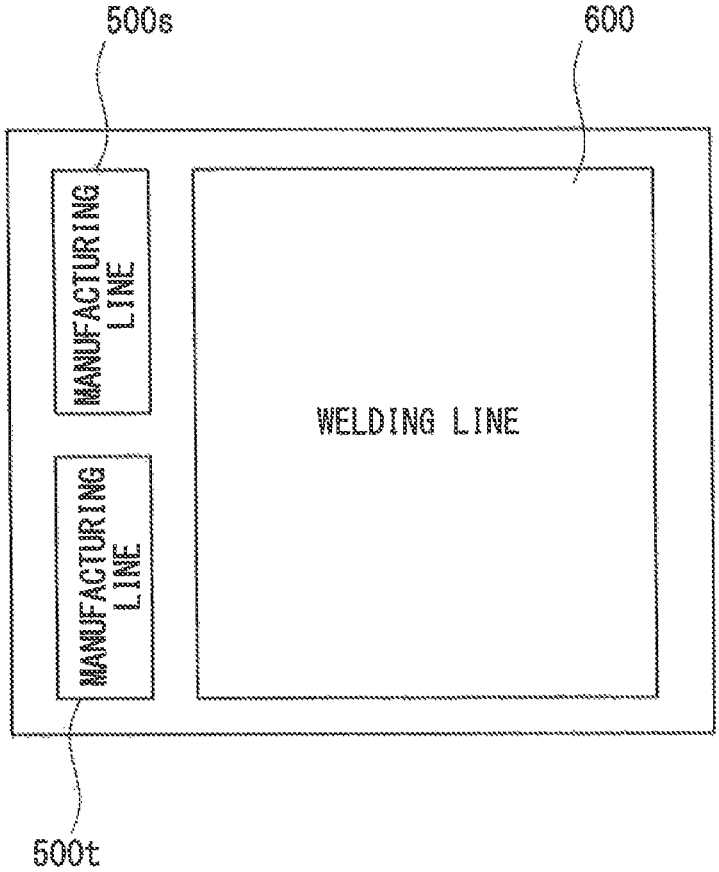
FIG. 20 is a schematic diagram showing a manufacturing line in which a manufacturing line using a press device according to the first exemplary embodiment is combined with a welding line.

Since the cost of the manufacturing line 500 is low, a number of manufacturing lines 500 can be installed in a factory. For example, as shown in FIG. 20, a manufacturing line 500*s* for components S and a manufacturing line 500*t* for components T can be installed adjacent to a welding line 600. The line that is installed adjacent to the manufacturing lines 500*s* and 500*t* is not limited to the welding line 600. That is, an assembling line and/or a processing line may be installed adjacent to the manufacturing lines 500*s* and 500*t*.

As a result, in comparison to related-art lot production, it is possible to supply only the necessary number of components to the subsequent process when they are required, thus eliminating the need for storing excess components and enabling the manufacturing cost to be lowered.

As has been explained above, according to the present invention, it is possible to provide a press device that is not unnecessarily large for works and hence has high design flexibility, a manufacturing line, and a manufacturing method of such a press device.

Second Exemplary Embodiment

Figure 21:
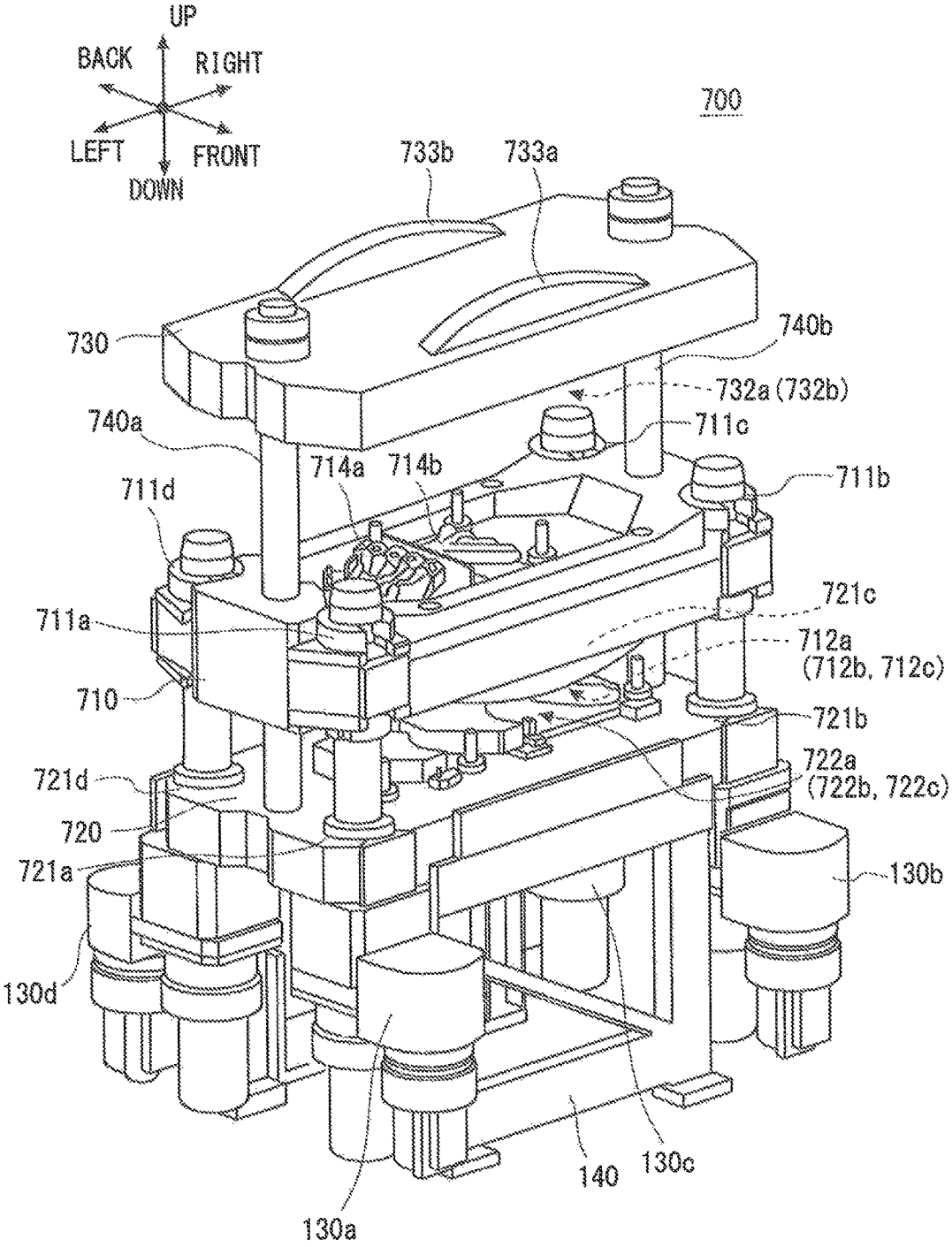
FIG. 21 is a perspective view showing a configuration of a press device according to a second exemplary embodiment.

A press device 700 according to a second exemplary embodiment is explained with reference to FIG. 21. The press device 700 includes a first metal mold 710, a second metal mold 720, a third metal mold 730, drive means 130*a* to 130*d*, a base 140, and poles 740*a* and 740*b*. The press device 700 sandwiches works between the first and second metal molds 710 and 720 and between the first and third metal molds 710 and 730, and thereby processes the works.

In the press device 700, the second metal mold 720 is fixed on the base 140 and the poles 740*a* and 740*b* are disposed in arranged positions in the second metal mold 720. Two through holes are formed in the first metal mold 710, and the first metal mold 710 is disposed so that it can be moved along the poles 740*a* and 740*b* through these through holes. The third metal mold 730 is fixed at the tops of the poles 740*a* and 740*b*. The first metal mold 710 can be vertically moved by the drive means 130*a* to 130*d*.

The third metal mold 730 is disposed so that the first metal mold 710 is positioned between the second and third metal molds 720 and 730. That is, the third metal mold 730 is disposed above the first metal mold 710 in FIG. 21.

The first metal mold 710 includes connection parts 711*a* to 711*d*, lower processing parts 712*a* to 712*c*, and upper processing parts 714*a* and 714*b*. The second metal mold 720 includes connection parts 721*a* to 721*d* and processing parts 722*a* to 722*c*. The third metal mold 730 includes processing parts 732*a* and 732*b* and reinforcement parts 733*a* and 733*b*.

Figure 22:
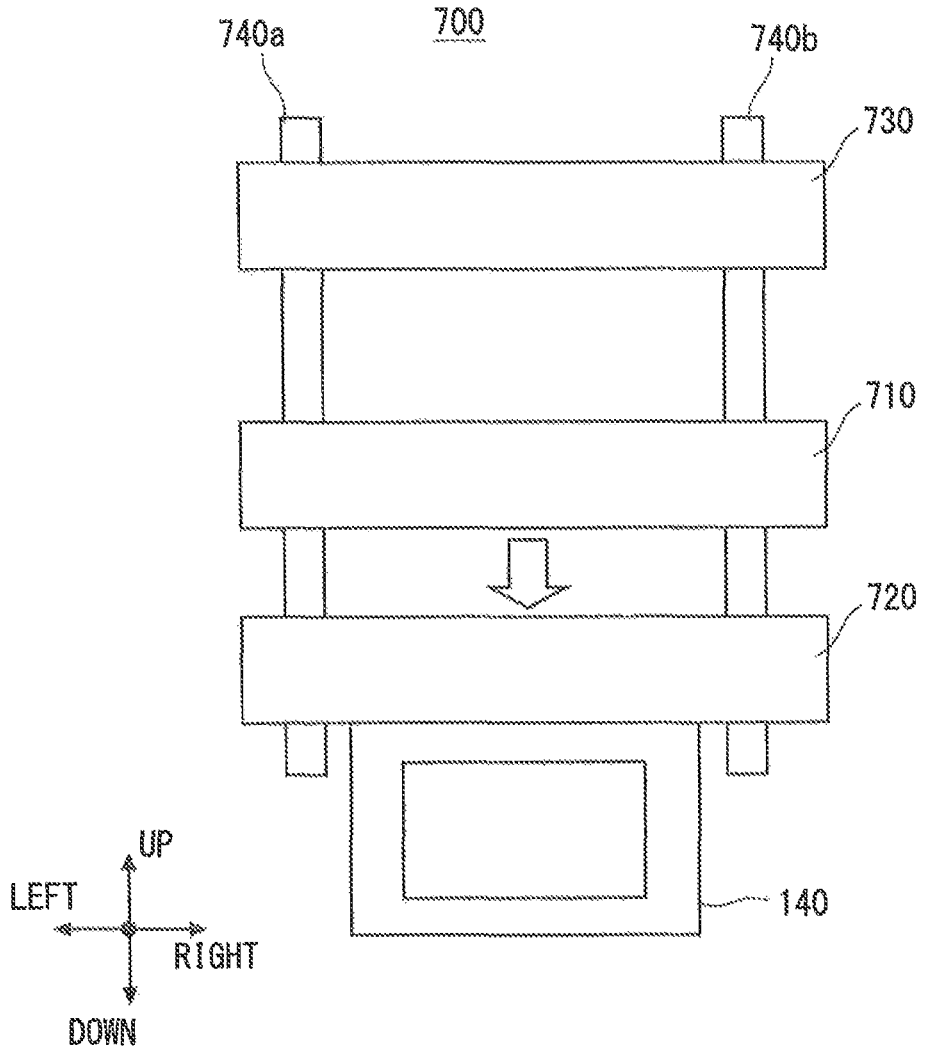
FIG. 22 is a first diagram showing a motion of the press device according to the second exemplary embodiment.

An operation of the press device 700 is explained with reference to FIGS. 22 and 23. As shown in FIG. 22, when the first metal mold 710 moves to the second metal mold 720 side, a work is processed by sandwiching the work between the upper processing parts 722*a* to 722*c* of the second metal mold 720 and the lower processing parts 712*a* to 712*c* of the first metal mold 710. In this state, since the space between the first and third metal molds 710 and 730 is widened, a work can be easily placed on the processing parts 714*a* and 714*b* of the first metal mold 710 or a work that has been already placed there can be easily moved. In this case, the first metal mold 710 functions as an upper mold and the second metal mold 720 functions as a lower mold in the press device 700.

Figure 23:
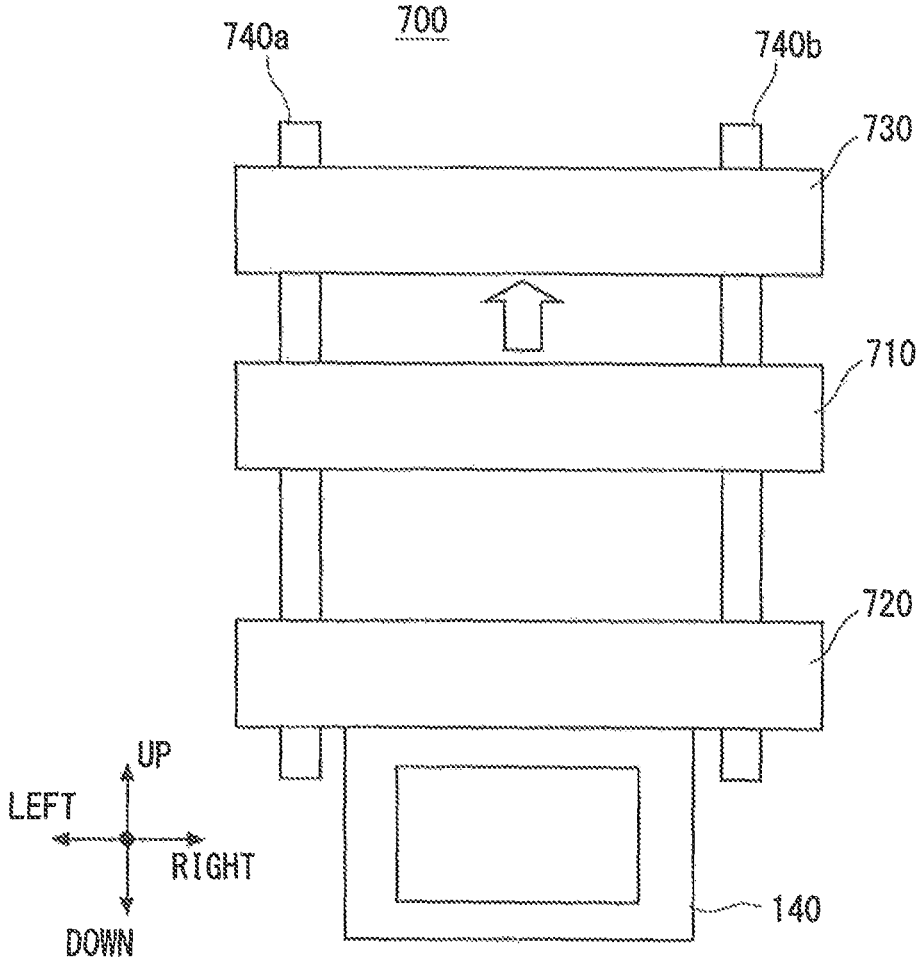
FIG. 23 is a second diagram showing a motion of the press device according to the second exemplary embodiment.

As shown in FIG. 23, when the first metal mold 710 moves to the third metal mold 730 side, a work is processed by sandwiching the work between the lower processing parts 732*a* and 732*b* of the third metal mold 730 and the upper processing parts 714*a* and 714*b* of the first metal mold 710. In this state, since the space between the first and second metal molds 710 and 720 is widened, a work can be easily placed on the processing parts 722*a* to 722*c* of the second metal mold 720 or a work that has been already placed there can be easily moved. In this case, the first metal mold 710 functions as a lower mold and the third metal mold 730 functions as an upper mold in the press device 700.

In an ordinary press device, one presswork is performed by one reciprocating vertical motion of a metal mold. In contrast to this, in the press device 700 according to this exemplary embodiment, presswork can be performed twice by one reciprocating vertical motion of the first metal mold 710. As a result, since the number of processes that can be carried out by one press device increases, the number of press devices used in the whole processes can be reduced. Consequently, the manufacturing cost can be reduced. Further, since the number of components that can be simultaneously processed by one press device increases, it can be expected that the manufacturing cost can be reduced owing to the improvement in the productivity.

Note that the present invention is not limited to the above-described first exemplary embodiment, and it can be modified as appropriate without departing from the sprit and scope of the present invention. For example, the press device according to the present invention is not limited to those in which the number of sets of metal molds is one or two. That is, the press device according to the present invention can also be applied to those where the number of sets of metal molds is three or more.

This application is based upon and claims the benefit of priority from Japanese patent application No. 2013-215540, filed on Oct. 16, 2013, the disclosure of which is incorporated herein in its entirety by reference.

REFERENCE SIGNS LIST

100, 700 PRESS DEVICE
110, 710 FIRST METAL MOLD
120, 720 SECOND METAL MOLD
111*a*-111*d*, 121*a*-121*d*, 711*a*-711*d*, 721*a*-721*d* CONNECTION PART
112*a*-112*c*, 122*a*-122*c*, 712*a*-712*c*, 722*a*-722*c*, 714*a*, 714*b*, 732*a*, 732*b* PROCESSING PART
113*a*-113*d*, 733*a*, 733*b* REINFORCEMENT PART
130*a*-130*d* DRIVE MEANS
140 BASE
500 MANUFACTURING LINE
600 WELDING LINE
730 THIRD METAL MOLD
740*a*, 740*b* POLE

The invention claimed is:

1. A press device comprising:

a first metal mold and a second metal mold, the first and second metal molds being configured to sandwich a work therebetween and process the work, the first and second metal molds including a plurality of processing parts configured to process the work according to a number of processing steps for the work; and a plurality of drive means configured to connect the first metal mold with the second metal mold, the plurality of drive means being configured to change a distance between the first and second metal molds, wherein:

each of the first and second metal molds includes a plurality of connection parts connecting the first metal mold and the second metal mold with the plurality of drive means, either the first metal mold or the second metal mold includes a reinforcement part, the reinforcement part enveloping the plurality of processing parts, the reinforcement part including an arc-shaped rib extending between connection parts of the plurality of connection parts, and the plurality of processing parts are configured to receive the work conveyed by a conveyance robot.

2. The press device according to claim 1, wherein the plurality of processing parts are arranged at unequal pitches in a work sending direction.

3. The press device according to claim 1, wherein the plurality of processing parts are arranged in a staggered manner as viewed from a work sandwiching direction.

4. The press device according to claim 1, wherein the plurality of processing parts are arranged in a point symmetry as viewed from a work sandwiching direction.

5. The press device according to claim 1, wherein the plurality of processing parts are divided into sets, the sets of the plurality of processing parts are respectively configured to press a plurality of works including the work for which the number of processing steps for each of the plurality of processing parts are different from each other.

6. The press device according to claim 1, further comprising a third metal mold disposed such that the first metal mold is positioned between the second and third metal molds, wherein:

when the first metal mold moves toward the third metal mold, the work is processed by sandwiching the work between the third and first metal molds, and when the first metal molds moves toward the second metal mold, the work is processed by sandwiching the work between the second and first metal molds.

7. The press device according to claim 1, wherein each drive means of the plurality of drive means is individually controlled.

8. A manufacturing line comprising:

the press device according to claim 1; and the conveyance robot that conveys the work.

9. The press device according to claim 1, wherein each drive means of the plurality of drive means includes at least one of (i) a hydraulic device, (ii) a servo-motor, and (iii) a ball screw.

* * * * *